United States Patent [19]

Pellerin

[11] 4,195,498

[45] Apr. 1, 1980

[54] AUTOMATIC LAUNDRY SYSTEM

[75] Inventor: Norvin L. Pellerin, New Orleans, La.

[73] Assignee: Pellerin Milnor Corporation (Entire), Kenner, La.

[21] Appl. No.: 903,115

[22] Filed: May 5, 1978

[51] Int. Cl.[2] ..... D06F 31/00

[52] U.S. Cl. ..... 68/3 R; 68/20; 68/27; 68/210

[58] Field of Search ..... 68/3 R, 20, 27, 210; 198/348, 349; 214/11 C

[56] References Cited

U.S. PATENT DOCUMENTS

| | | | |
|---|---|---|---|
| 3,610,159 | 10/1971 | Fickenscher | 198/349 X |
| 3,686,899 | 8/1972 | Rosenfeld et al. | 68/3 R |
| 3,742,738 | 7/1973 | Frotriede | 68/210 |
| 3,803,556 | 4/1974 | Duffy | 198/349 X |
| 3,915,284 | 10/1975 | Knockeart et al. | 198/349 |

*Primary Examiner*—Philip R. Coe

*Attorney, Agent, or Firm*—Clarence A. O'Brien; Harvey B. Jacobson

[57] ABSTRACT

A wholly automatic commercial laundry in which soiled laundry is automatically routed to available washing machines, is automatically unloaded, conveyed, and loaded into one of several dryers which is available, or is conveyed directly to a finishing station when drying is not required. A unique programmable selector permits selecting any of several preprogrammed washingcycles, and modifying these cycles in accordance with the laundry to be washed. The selector also provides the necessary information for routing of the batches of laundry from the washing machines to the dryers, for selecting one of several drying cycles, and for routing the laundry to a desired finishing station.

11 Claims, 11 Drawing Figures

AUTOMATIC LAUNDRY SYSTEM

One aspect of this invention relates to a wholly automatic laundry in which the laundry to be washed is automatically processed in accordance with a cycle of operation selected in the soiled laundry room without requiring any further operator attention.

In addition, the invention relates to a unique rotary selector switch arrangement having a plurality of switch elements for modifying a pre-programmed cycle of operation of a washing machine. In a variation, this selector also selects the drying cycle, the ultimate destination to which the laundry is sent automatically, and otherwise controls the automatic laundry.

At present in many commercial laundry establishments, the operator has a choice of, for example, three different washing cycles, one of which is selected by the operator at the time the washing machine is loaded with the soiled laundry. The controller for the washing machine contains the three programs and operates the washing machine in accordance with the selected cycle. In addition, there are frequently toggle switches associated with the controller which enable the operator to eliminate or modify a function of the selected programmed cycle. For example, it is customary, to save water, to pump the rinse water to a storage tank for reuse as the wash water of subsequently washed laundry. However, where the laundry washed is colored, for example red tablecloths, the rinse water is pink and cannot be reused. In such a situation the operator would actuate a "drain to sewer" switch. Similarly switches have been provided to change other functions such as water level, water temperature, and slow cooldown (where laundry has permanent press characteristics). Sucn individual switch selections however, require a careful, highly trained operator with considerable expertise in the laundry field to select the proper modification of a preset washing formula as well as the selection of the basic formula itself.

In accordance with the invention, the selection of the basic formula as well as the required modification is made by simply moving a rotary selector switch to a position in which the common name of the soiled laundry to be washed appears on the selector. Setting the switch to the required position selects the appropriate one of the three available washing cycles as well as the proper modification of the cycle to perform the required washing operation. Hence, anyone who can read and recognize different types of laundry can pre-select the desired washing cycle simply by rotating the selector to a position in which the laundry name is exposed.

In addition, the invention relates to a wholly automatic laundry in which, in accordance with a pre-selected cycle of operation, the laundry is automatically loaded into a washing machine, is automatically washed in the washing machine according to the pre-selected cycle, is automatically conveyed to either an available dryer when the laundry requires drying or directly to a selected finishing station. Where drying is required, the drying is also accomplished in accordance with the pre-selected cycle, and after drying, the dryer automatically unloads and the laundry is automatically conveyed to a selected final station.

Commercial laundries are presently faced with increased labor costs and the difficulty of finding reliable people. In accordance with this aspect of the invention, there is provided a reliable wholly automatic commercial laundry in which no operator attention is required other than recognizing the batch of laundry which is to be washed, and selecting a processing cycle corresponding to the common name of the goods such as white terrycloth towels, colored table linens, white flat work, etc. The operator need only be able to read and recognize the kinds of laundry to operate the automatic system. Such selection which can be made in the soiled laundry room pre-selects the proper wash cycle and its modification, the proper drying cycle (if the laundry is to be dried), or alternatively an ironing station, as well as the ultimate destination of the laundry from the dryer. All this is accomplished by the simple selection on a selector of a name corresponding to the common name of the laundry to be processed. Advantageously, the selector is a programmable, multi-position, multi-content rotary selector switch.

Commercial laundries frequently include several washing machines, several dryers, and other finishing stations such as ironing or folding stations. For maximum efficiency, it is required that each washing machine be loaded with soiled laundry as soon as possible after washed laundry is removed from the machine. In addition, it is also desirable to immediately transfer washed laundry to either a dryer if the laundry requires drying, or a selected finishing station as soon as possible after the laundry is washed. Also, dried laundry should immediately be transferred to a folding station or other final station as soon as possible after it is dry so that the dryers can be used with maximum efficiency. Any delay in unloading a washing machine or reloading it, as well as any delay in loading or unloading a dryer, results in a decrease of the capacity of the commercial laundry, and hence, causes inefficiency.

In accordance with the present invention, such inefficiency of operation is wholly overcome by fully automating a commercial laundry.

Systems for loading washing machines in commercial laundries are of various types. Some laundries have loading conveyors, some laundries use pneumatic systems or sling systems, and in some instances, there is an individual loading chute for each washing machine and the individual chutes are loaded from a soiled laundry room usually located on the floor above the laundry washing room.

In its simpliest form, the automatic laundry aspect of the invention relates to an automatic control for a commercial laundry or cleaning establishment where there is a separate loading chute for each washing machine, the inlet ends of these chutes being loaded from the soiled laundry room. In accordance with the invention, there is a selector located at the laundry loading opening of each chute. This selector when set by the operator who loads the laundry into the chute, selects the entire program so that the laundry is processed wholly automatically. In this form of the invention with individual loading chutes, a particular washing machine may be washing a previous batch of laundry when the loading chute is loaded. As soon as the washing meachine is available, the machine signals that it is ready to receive the soiled laundry from the chute and the laundry is automatically loaded into the machine. At the time that the laundry is loaded into the chute, the selected program for the laundry is automatically transferred to a controller for the washing machine. The washing machine then washes the laundry in accordance with any one of several normal wash cycles as selected or as modified by the selected program transferred to the controller. When washing is completed, the washing machine signals that it is ready to unload, and when a conveyor or other transfer device becomes available, the washing machine automatically unloads and the washed laundry is automatically conveyed or transferred to either an available dryer, if drying is required, or to a pre-selected finishing station when drying is omitted. Since one does not know which washing machine will finish washing first, the drying or finishing station information is transferred to the conveyor or transfer device control only after washing is completed. Where drying is required, the program information is transferred to the dryer control to select the drying cycle and provide the final destination information for the laundry in the dryer. After drying, the conveyor control receives the final destination information from the dryer control so that the laundry is conveyed to the selected final station. In this manner, by transferring the pre-selected program information to "track" the laundry, the laundry is automatically processed and conveyed to its final destination.

Where a storage station such as a section of the conveyor is provided between the washing machine and the dryers, an additional intermediate program storage unit is required to track the laundry. Also, where the loading system is more sophisticated, and includes storage conveyors in the soiled laundry room, additional units are required to store the selected program at each additional laundry storage station.

Correspondingly, an object of the invention is a fully automatic commercial laundry or cleaning establishment which requires virtually no operator attention.

Another object is an automatic commercial laundry in which the entire washing, drying, and routing of the laundry is pre-selected simply by setting the selector to the common name for the laundry and thereafter, all processing of the laundry is automatic.

A further object of the invention is a unique selector and controller in the form of a multi-position, multi-terminal selector switch for pre-selecting any of a number of regular wash cycles, for modifying such cycles, and for storing, routing, drying, and destination information for laundry being washed.

A further object of the invention is a unique multi-position, multiple pole chart type selector switch comprising means for selecting one of a plurality of washing machine operation cycles and modifying these cycles in accordance with a preselected program.

A further object of the invention is a washing machine program selector for selecting one of a plurality of pre-determined washing cycles and modifying the washing cycles in accordance with another pre-selected program by the single setting of a multi-position chart type selector switch.

Additional objects, features, and advantages of the invention will become apparent from the accompanying drawings.

DETAILED DESCRIPTION

Figure 1:
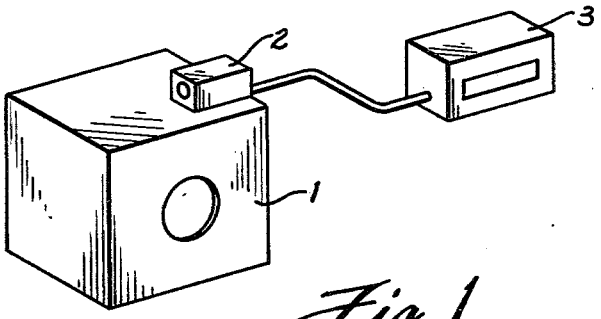
FIG. 1 is a diagrammatic view showing a washing machine control system according to the invention.

FIG. 1 shows the selector control arrangement of this invention in its simpliest form. As shown in FIG. 1, there is a washing machine 1 having a motor driven controller 2 which operates the various control circuits of the washing machine to operate the washing machine automatically to wash laundry in accordance with a selected one of three different present programs of the controller. A selector 3, in accordance with the invention, both selects the washing cycle and substantially modifies the cycle simply by rotating the selector to a position indicative of the type of laundry to be washed. The controller 2 and the circuitry operated by the controller to supply soap and various other chemicals, operate the wash motor, and automatically drain and fill the washing machine at preselected times, form no part of this invention and can be of type disclosed in U.S. Pat. Nos. 2,779,937, and 3,919,864.

The controller 2 can be a timer motor driven controller of the programmable chart type as disclosed in U.S. Pat. No. 2,779,937 where a plurality of contact fingers are urged toward a conductive drum driven by the motor, and a chart sheet of insulating material is attached to and rotates with the drum. Cutouts or perforations are formed in the chart so that selected contact fingers engage the drum and close or open required circuits to automatically operate the machine.

Typical operations performed where a washing machine is used for dyeing are disclosed in the aforementioned U.S. Pat. No. 3,919,864.

Figure 2:
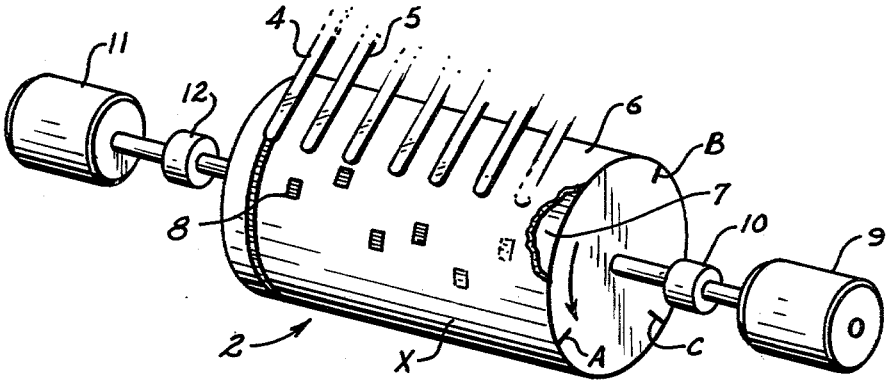
FIG. 2 is a pictorial view showing a washing machine controller.

Controller 2 typically takes the form shown at FIG. 2. As shown, there are a plurality of contact fingers such as 4,5, which are resilient and urged against an insulating material chart sheet 6 on an electrically conductive metal drum 7. Finger 4 is a common or return finger so that an electric circuit is completed through finger 5, drum 7 and finger 3 when the contact tip of finger 5 engages the drum through an opening 8 cut in the chart.

Typically, chart 7 is precut to permit selecting a desired one of three different complete washing cycles. The start of these cycles is indicated as A, B, and C. The portion of the chart between A and B is cut to control a normal wash cycle, the portion between B and C is cut for a different cycle, for example, a small load, and the portion between C and A provides another predetermined washing machine cycle. It is at present customary to drive drum 8 with a slow speed timer motor 9 via a one way clutch 10. Motor 9 drives the drum very slowly, for example, one revolution in 96 minutes, and the time for one revolution can be further extended by energizing the motor intermittently during certain portions of the cycle as disclosed in U.S. Pat. No. 3,710,600, or by reducing the speed of the motor during certain portions of the cycle. In this way, a complete washing formula is controlled when the chart traverses the fingers for example from position A to position B.

A motor 11 is also connected to the drum via a one way clutch 12, this clutch overruning when motor 9 drives the drum. When motor 11 drives the drum, clutch 10 overruns and the drum is under the control of motor 11. Motor 11 drives the drum at 2 rpm and is used to drive the drum and its chart rapidly to positions A, B, or C, and is also used to drive the drum to skip or eliminate portions of each formulas cut in the chart. In the past, the selection of wash formula A, B, or C was controlled by manually actuating similarly designated toggle switches. In some systems, no motor 11 was provided and the drum and chart were manually rotated to the appropriate start positions for the washing formulas A, B, and C. Modification of the selected wash cycle was also possible by manually operating toggle switches to change for example, water level, water temperature, wash time, or the extraction cycle.

Such controllers are now widely used in the commercial laundry industry because the basic washing formulas will be different in various parts of a country and will differ from country to country. Use of a programmable chart 6 permits the laundry operator to cut in the chart three basic cycles of operation for the most efficient washing of the majority of soiled goods washed by the laundry. In the past, to select and vary the operation of one of the basic cycles, it was necessary to manually operate the four available toggle switches or where a substantially different washing formula was required, it was necessary to remove the chart and replace it with a differently cut chart.

In accordance with this invention, one of the basic wash cycles A, B or C is selected, and the selected cycle is greatly modified, by simply setting the selector 3 to a position corresponding to the name of the laundry to be washed.

Figure 3:
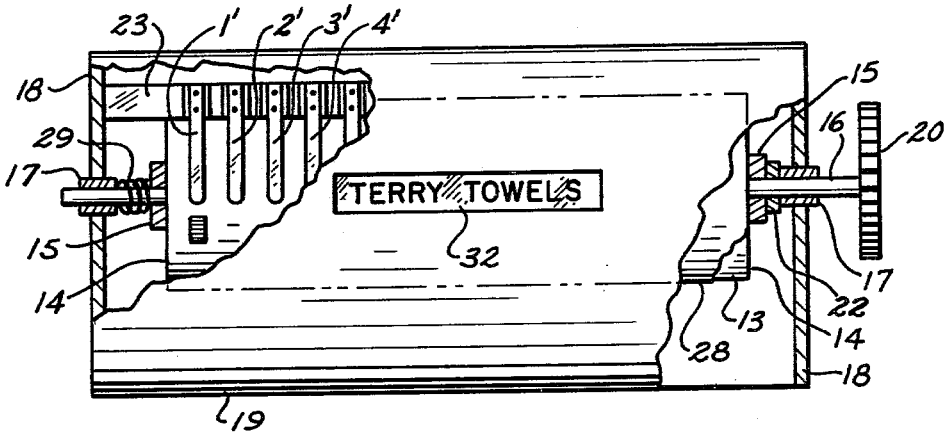
FIG. 3 is a front view with portions broken away and showing one form of selector according to this invention for controlling the washing machine of FIG. 1.

Rotary selector 3 is shown at FIG. 3. The selector includes a drum with an electrically conductive cylindrical surface 13 and ends 14 of electrically insulating material. A hub 15 is secured to each end 14, and a shaft 16 extends through and is fixed to the hubs. Bearings 17 are provided respectively in the sidewalls 18 of selector housing 19, and a knob 20 is fixed to one end of shaft 16. A retainer collar 22 maintains the drum in a predetermined axial position within the housing and prevents endwise movement of the drum.

Mounted in housing 19 is a terminal strip 23 of insulating material and secured to the terminal strip are a plurality of resilient conductive contacts, only four of which are shown and which are designated 1'–4'. There are in fact thirty-four contact fingers mounted on terminal strip 23. Each finger is positioned to press against the surface of an insulating material chart sheet 28 which extends around the conductive surface 13 of the drum and is releaseably secured to the drum. The drum is maintained in a position to which it is set manually by knob 20, by a brake which includes a compression spring 29 extending around the shaft, and which presses the drum toward the right in FIG. 3.

Figure 4:
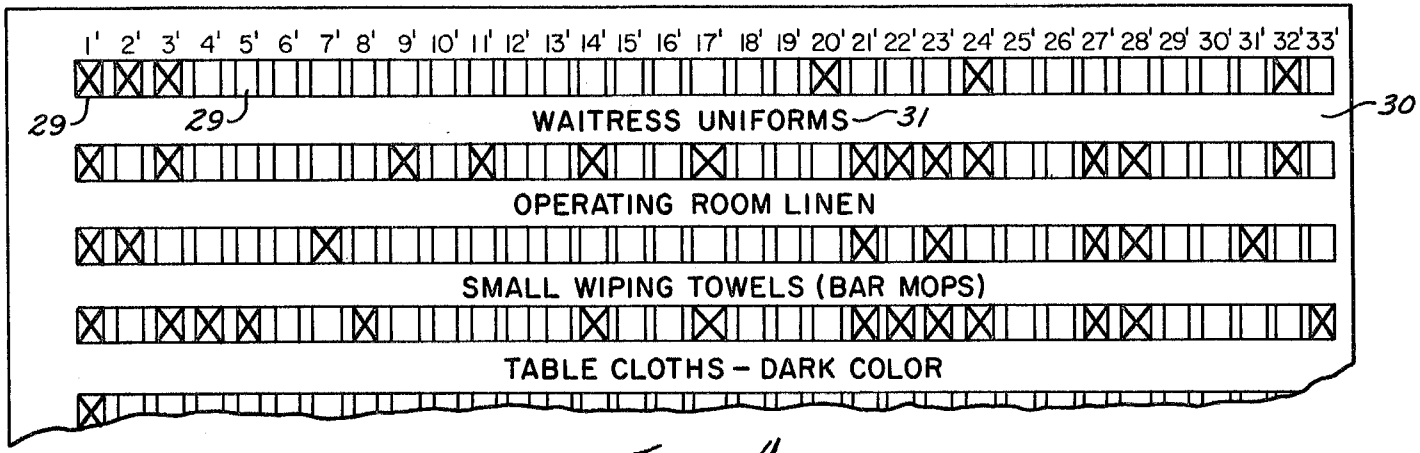
FIG. 4 is a partial view of a program chart used with the selector of FIG. 3.

Chart 28, as shown at FIG. 4, has printed thereon, a plurality of horizontal rows of cutout designated blocks 29. There are thirty-four blocks in each horizontal row, and the blocks of each row are vertically aligned on chart 28. Each block 29 of a horizontal row corresponds to the location of a contact finger of the selector, when the chart is mounted on the selector drum 13. The vertical rows of aligned blocks are designated 1'–33' to correspond to the contact fingers 1'–33'. Each block 29 of a horizontal row indicates the region of the chart which should be cut away in order to select a particular wash cycle and its modification. Spaces 30 are provided below each horizontal row of blocks to receive labels or printing 31 to indicate the type of laundry which is properly washed by the program cut in the horizontal row immediately above the space.

While there are thirty-six horizontal rows of blocks 29, in the preferred embodiment of chart 28, only several rows are shown for purposes of illustration. The first block of each row corresponds to the common or return finger 1' of the selector, and is cutout in all the rows. In the drawing, a cutout is designated by an X in the cutout block. The functions of the fingers when the corresponding blocks are cut out are indicated in Table I. The preferred cut outs for several items of laundry are shown at FIG. 4. It will be appreciated however that these cut outs and functions can differ depending on the needs of the laundry and the country or region of a country where the commercial laundry is located.

Since the chart 6 of controller 2 can be programmed to meet the needs of a particular laundry, and since the chart 28 of the selector 3 can also be programmed to meet the needs of the laundry, the system of this invention enables the selection of a wide variety of different washing cycles by simply rotating knob 20 of the selector so that the name of the laundry appears in the window 32 of selector housing 19. By virtue of this simple selection, the washing machine is fully programmed to wash the laundry, and the possibility of human error by the operator is vastly reduced.

While selector 3 has been described as including conductive contact fingers such as fingers 1'–4', it will be appreciated that microswitches could be used in place of the fingers, the microswitches being actuated by their operating arms entering cutouts at the location of selected blocks 29 of the chart. However, the arrangement of resilient contact fingers and a conductive drum makes the selector 3 described above quite inexpensive to manufacture.

TABLE 1

| SELECTOR FINGER ASSIGNMENTS | |
|---|---|
| 1' | COMMON |
| 2' | SELECTS BASIC WASH PROGRAM #1 |
| 3' | SELECTS BASIC WASH PROGRAM #2 |
| 2'+3' | SELECTS BASIC WASH PROGRAM #3 |
| 4' | OMIT SEGMENTS A IN WASH PROGRAMS A, B OR C |
| 5' | OMIT SEGMENTS B IN WASH PROGRAMS A, B OR C |
| 4'+5' | OMIT SEGMENTS A +B IN WASH PROGRAMS A, B OR C |
| 6' | AUTOMATIC PRE-EXTRACT AT BEGINNING OF FINAL EXTRACT |
| 7' | SELECTS NON-REVERSING MODE DURING WASHING |
| 8' | SELECTS DRAIN-TO-SEWER INSTEAD OF TO REUSE WATER STORAGE |

TABLE 1-continued

| SELECTOR FINGER ASSIGNMENTS | |
|---|---|
| 9' | SELECTS FILL-FROM-FRESH WATER INSTEAD OF FROM REUSE WATER |
| 10' | SELECTS SOAP QTY A' INSTEAD OF SOAP QTY A |
| 11' | SELECTS SOAP QTY B' INSTEAD OF SOAP QTY B |
| 12' | SELECTS SOAP QTY C' INSTEAD OF SOAP QTY C |
| 13' | SELECTS ALKALI QTY A' INSTEAD OF ALKALI A |
| 14' | SELECTS ALKALI QTY B' INSTEAD OF ALKALI B |
| 15' | SELECTS ALKALI QTY C' INSTEAD OF ALKALI C |
| 16' | SELECTS BLEACH QTY B INSTEAD OF BLEACH QTY A |
| 17' | SELECTS NO BLEACH IN THIS FORMULA |
| 18' | SELECTS SOUR QTY B INSTEAD OF SOUR QTY A |
| 19' | SELECTS NO SOUR IN THIS FORMULA |
| 20' | SELECTS STARCH QTY B INSTEAD OF STARCH QTY A |
| 21' | SELECTS NO STARCH IN THIS FORMULA |
| 22' | SELECTS SUPPLY #6 QTY B INSTEAD OF SUPPLY #6 QTY A |
| 23' | SELECTS NO SUPPLY #7 IN THIS FORMULA |
| 24' | SELECTS NO SUPPLY #8 IN THIS FORMULA |
| 25' | SELECTS USE TEMP $T_3$ INSTEAD OF $T_4$ IN THIS FORMULA |
| 26' | SELECTS USE TEMP $T_2$ INSTEAD OF $T_3$ IN THIS FORMULA |
| 27' | SELECTS NO COOLDOWN IN THIS FORMULA |
| 28' | DISABLES "LO EXTRACT SPEED ONLY" IN THIS FORMULA |
| 29', 30' | SELECTS DRY CYCLES |
| 31', 32', 33' | SELECT FINISHING DESTINATIONS i.e. FOLDING STATION #1, IRONER #1, IRONER #2, ETC. |

TABLE 2

| STANDARD WASH PROGRAM A | POSSIBLE MODIFICATIONS |
|---|---|
| Reversing washing | Non-reversing washing |
| Drain to reuse water storage | Drain to sewer |
| Fill from reuse water | Fill from fresh water |
| Soap QTY A | Soap QTY A' |
| Soap QTY B | Soap QTY B' |
| Soap QTY C | Soap QTY C' |
| Alkali QTY A | Alkali QTY A' |
| Alkali QTY B | Alkali QTY B' |
| Alkali QTY C | Alkali QTY C' |
| Bleach QTY A | Bleach QTY B |
| | No bleach |
| Sour QTY A | Sour QTY B |
| | No sour |
| Starch QTY A | Starch QTY B. |
| | No starch |
| Supply #6 QTY A | Supply #6 QTY B |
| Supply #7 | No supply #7 |
| Supply #8 | No supply #8 |
| Temp $T_4$ | Temp $T_3$ |
| Temp $T_3$ | Temp $T_2$ |
| Cooldown | No Cooldown |
| No automatic pre-extract | Automatic pre-extract before final extract |
| Lo extract speed | Hi extract speed |

Figure 5:
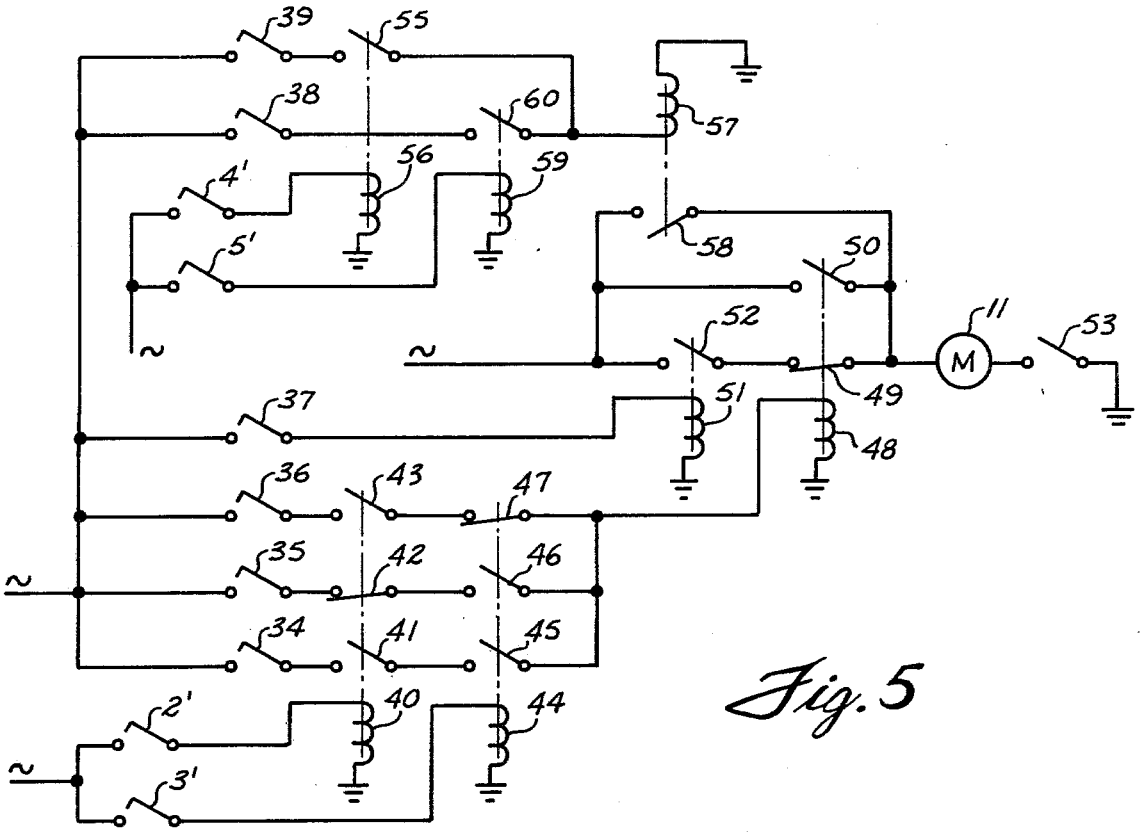
FIG. 5 is a circuit diagram showing the control by the selector of wash cycle selection and cycle segment omission.

Table 2 shows a standard wash program A, and the modifications which can be made to the wash program by forming openings in chart 28 at the locations of the various blocks 29. When an opening is cut only at the location of a finger 2' (and at the common finger 1') standard wash program A is selected, and the laundry is processed in accordance with this pre-selected standard wash program. Where it is desired to modify the standard wash program A, some of the possible modifications which can be made are listed under the column "Possible Modifications". The manner in which a selected one of wash programs A, B, and C is selected, and how portions of the selected program can be eliminated or modified, will now be explained. FIG. 5 shows a portion of the control circuit for rapid advance motor 11 of controller 2. These fingers are designated 34–39. Also shown at FIG. 4 are control fingers 2'–5' of selector 3. A relay coil 40 in series with finger 2' controls contacts 41–43 and a relay coil 44 in series with finger 3' controls contacts 45–47. Fingers 34–36 of controller 2 control a relay coil 48 with contacts 49 and 50. A finger 37 controls a relay coil 51 of the time delay type which operates a contact 52. Motor 11 of controller 2 is connected in series with the several contacts shown and with a start switch 53.

At the end of a wash cycle, when drum 7 of controller 2 reaches, for example, position B (the end of wash cycle A) the drum is rapidly advanced by motor 11 to a home or start position indicated on FIG. 2 by the line X. A slot is cut in chart 6 at this home position for each of the fingers 34–36. However, the slot is very short and simply serves to start motor 11 and drive it to the position A of the drum. The slot for finger 36 which selects the wash cycle A terminates when the drum reaches the position A beneath the contact fingers. The slot for finger 35 which selects wash cycle B extends completely through the chart from A to B and the slot for the finger 34 which selects cycle C extends completely through the chart from A through C. To select cycle A, chart 28 of controller 3 is cut at a position corresponding to finger 2'. Hence, when the selector is rotated to the desired position relay coil 40 is energized closing contact 43 and thus energizing relay 48. This causes motor 11 to advance until the finger 36 comes out of the short slot in chart 6 thereby de-energizing relay 48 and opening contact 50. Slow speed timer motor 9 then drives drum 7 through wash cycle A. Had finger 3' been closed instead of finger 2', the closed circuit through finger 35 and the closed contact 42 and 46 would have energized relay 48 to maintain motor 11 energized until the finger 35 came out of its slot in chart 6, which would have been at position B. If both fingers 2 and 3 made contact, control would have been with finger 34 and drum 7 would have advanced to position C.

Where it is desired to skip a portion of the selected cycle, slots are cut in chart 6 at the locations of fingers 38 or 39. To omit, for example, a segment A of the wash cycle, a slot is cut under finger 39 and a slot is cut in chart 28 at finger location 4' so that contact 55 is closed by its relay coil 56. When finger 39 then engages drum 7, relay coil 57 is energized to close contact 58 and then cause rapid advance of motor 11 until finger 39 is again separated from the conductive drum. Finger 38 controls the omission of segment B of a wash cycle and will include a slot under the finger but at a different location on chart 6 from the slot for finger 39. Where the omission is wanted, chart 28 is cut so finger 5' engages and relay 59 is energized to close contact 60. Hence, rapid advance contact 58 will again be closed to rapidly traverse the pre-selected portion of a wash cycle. With both fingers 4' and 5' contacting, and contacts 55 and 60 both closed, both segments A and B of the wash cycle will be omitted.

When the drum reaches the end of a cycle, finger 37 makes brief contact to energize time relay 51 thereby closing contact 52 and returning the drum to home position X, which causes switch 53 to open. The next time switch 53 is energized, the cycle starts again.

Figure 6:
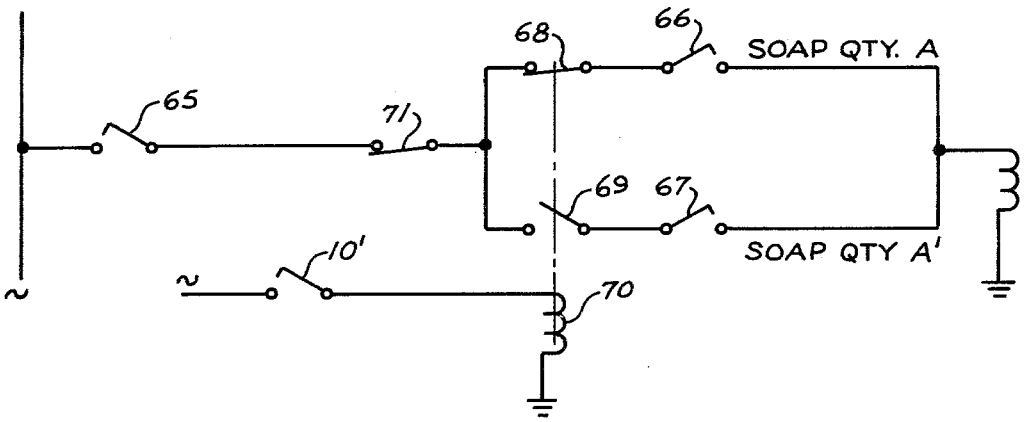
FIG. 6 is a circuit diagram showing the control of injection quantity modification by the selector.

FIG. 6 shows a circuit for selecting an alternate soap quantity such as soap quantity A' instead of soap quantity A which is controlled by finger 10' of selector 3. Controller 3 selects the soap, alkali, etc. whereas a timer driven controller selects the quantity of the injected product. As shown at FIG. 6, a finger 65 of controller 2, when it makes contact, selects soap. The duration of injection is, however, controlled by fingers 66 and 67 of a rapidly driven timer (not shown) depending on which one of switch contacts 68, 69 is closed. If, for example, finger 10' of selector 3 does not contact the conductive drum 13, quantity A is selected by virtue of the slot cut in chart 6 of controller 2 under finger 66. With switch fingers 65 and 66 both closed, the circuit of FIG. 6 energizes a solenoid valve which causes injection of liquid soap until finger 66 opens. Had finger switch 10' of controller 3 been closed, relay coil 70 would have opened switch 68 and closed switch 69 so that the duration of injection would have been determined by the contact time of finger 67.

In a similar manner, quantities B' and C' of the various different injected substances can be selected instead of the normal quantities A, B and C programmed in chart 6.

To wholly eliminate an injection such as "no bleach" or "no sour", a normally closed relay contact can be used such as contact 71 of FIG. 6, such a contact completely eliminating the injection when its relay is energized.

Figure 7:
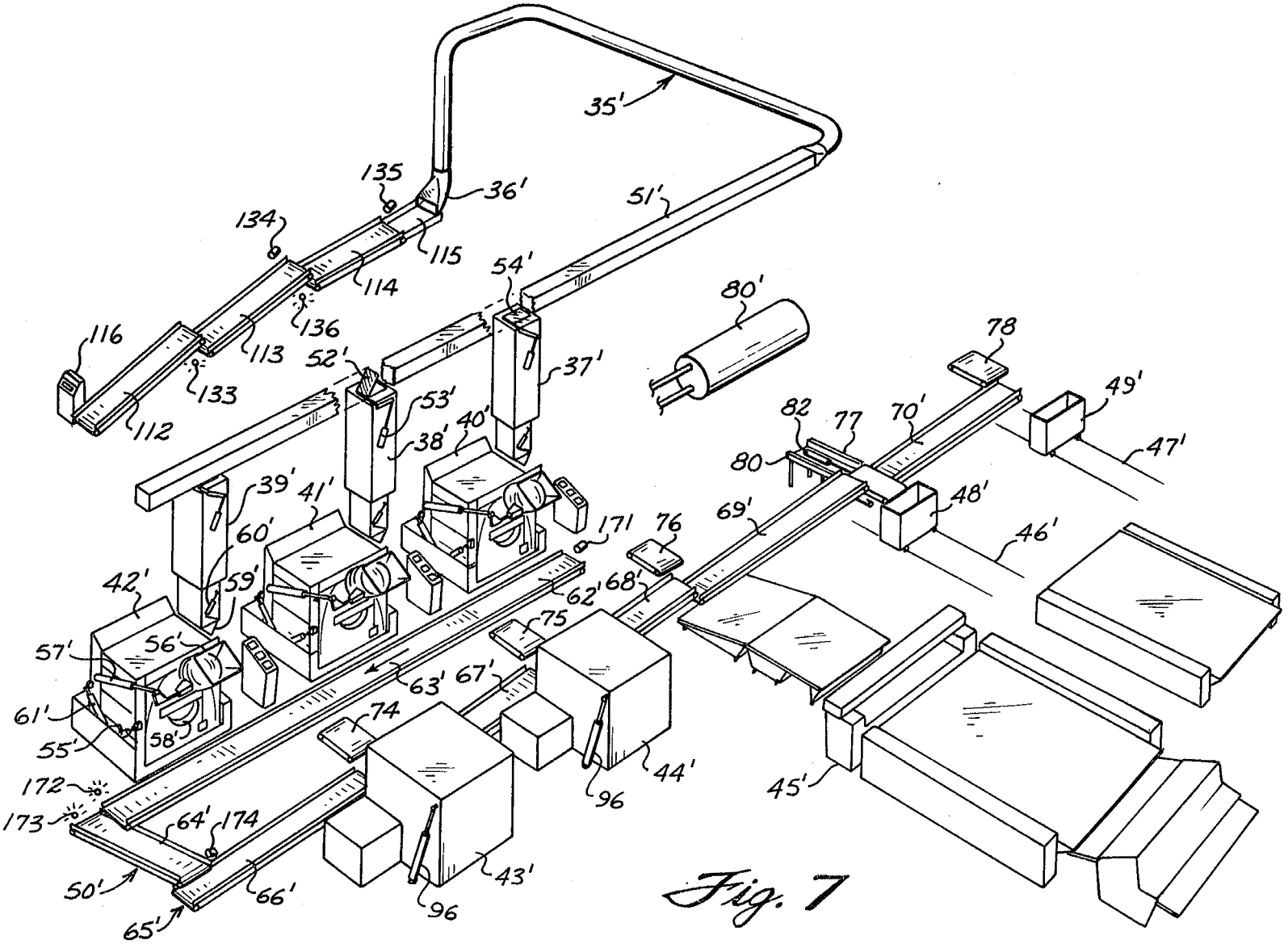
FIG. 7 is a diagrammatic view in perspective of an automatic laundry according to the invention.

FIG. 7 shows a typical arrangement for an automatic laundry according to this invention. The automatic laundry includes a conventional pneumatic conveyor system 35' for delivering soiled laundry from a sorting or soiled laundry room where laundry inlet 36' is located, to the respective loading chutes 37'–39' of a plurality of washer-extractors 40'–42'. The laundry room area where the washers are located also includes a plurality of dryers 43', 44', an ironing station 45', a folding station 46', and an addition station 47'. Associated with the folding station 46' and additional station 47' are several storage carts 48', 49'.

A conveyor system 50' automatically receives laundry from any of washers 40'–42' and automatically delivers the washed laundry to the dryers 43', 44', to the ironing station 45', or to the carts at the stations 46' or 47', depending on the nature of the laundry and the final finishing to be performed on the laundry. Conveyor 50' also automatically receives laundry from the dryers 43', 44' and transports and automatically unloads the laundry into carts at station 46' or station 47'.

Located within duct 51' of conveyor system 35', at the upper end of each of chutes 37'–39' is a laundry chute loading door 52' operated by a remotely controlled pneumatic cylinder 53' to swing upwardly to the position shown for door 52' of chute 38' so that laundry flowing through duct 51' falls downwardly into chute 38'. The loading door 54' of chute 37' is closed during loading of chute 38', and the loading door for chute 39' is also closed.

Each of washers 40'–42' is of the type available from Pellerin Milnor Corporation under the name HANDS-OFF. Such a washer is typically of the type shown in U.S. Pat. Nos. 3,919,864 or 3,610,001. Each washer is further equipped for automatic loading and unloading. For loading, the entire washer, such as washer 42', can be tilted rearwardly by the action of a pair of front hydraulic cylinders 55' to cause the machine to tilt back approximately 30° about a rear pivot of the washer. Where the loading chutes for example chute 39' is of the fixed type shown (in contrast to another conventional type of chute which can swing into the washing machine door opening to load laundry into the washer), a funnel-like intermediate guide chute 56' is provided on each machine. Guide chute 56' is moved by a pneumatic cylinder 57' to a loading position (washer tilted rearwardly) in which laundry from chute 39' is funneled through the door opening 58' at the front of the washing machine. Cylinder 57' also moves the intermediate chute to an inactive position away from opening 58' so it does not interfere with unloading of washed laundry onto the conveyor.

At the lower end of each of chutes 37'–39', is a door 59' which is opened and closed by an automatically controlled pneumatic cylinder 60'. When the door 59' is open laundry falls from the chute into the guide chute 56' to load soiled laundry into the washing machine.

For unloading, each washing machine has a pair of rear hydraulic cylinders 61' which tilt the machine forward about a front pivot when the rear of the machine is lifted by the cylinders so that the washed laundry from the machine can be unloaded onto the conveyor by slow rotation of the horizontal drum or basket of the washing machine.

Extending horizontally along washer extractors 40'–42' is an unloading section 62' of conveyor system 50' which conveys laundry in the direction of arrow 63'. The discharge end of conveyor section 63' feeds the washed laundry to a transverse conveyor 64'. Conveyor 64' feeds the laundry to a section 65' of the conveyor system.

Figure 8:
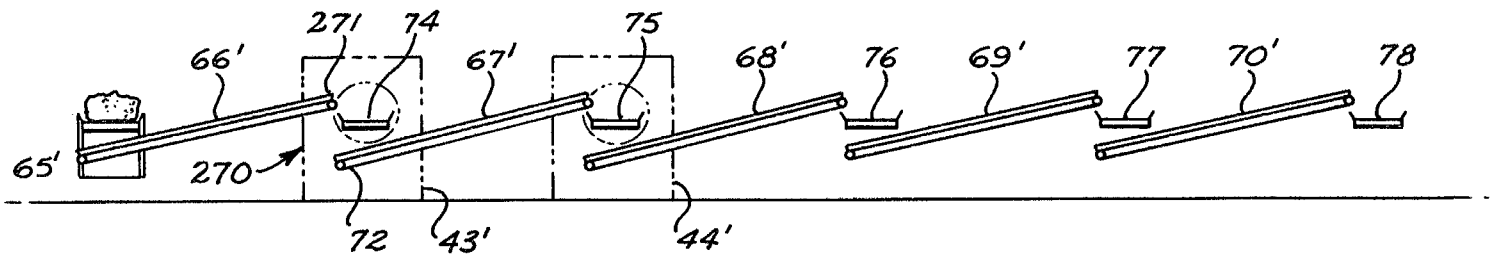
FIG. 8 is a view in elevation and showing the dryers in phantom lines.

As shown at FIG. 8, section 65' of the conveyor system includes a plurality of upwardly inclined conveyors 66'–70'. The discharge end of each upstream conveyor is elevated above the inlet end of each downstream conveyor to provide a vertical space between each discharge end of one conveyor and inlet end of the next conveyor, such as the space 270 between the discharge end 271 of conveyor 66' and the inlet end 72 of conveyor 67'. Extendable into the spaces such as the space 70 are a plurality of transfer conveyors 74–78. As shown for transfer conveyor 77 each transfer conveyor is mounted on a frame 80, and is moved between the extended position shown for conveyor 77 and the retracted position of conveyor 76 by a motor 82 which can be an air cylinder. Each of transfer conveyors 74–78 is a motor driven belt conveyor which conveys laundry to the selected finishing station when the conveyor is extended. As shown at FIG. 8, transfer conveyors 74 and 75 are aligned vertically and horizontally with the door openings of dryers 26 and 27. To load laundry into dryer 43' transfer conveyor 74 is extended and its motor energized to transfer laundry received from conveyor 66' into the dryer 43'. Similarly, if any one of transfer conveyors 75–78 is extended, laundry travelling along conveyor section 65' is transferred to a selected station such as the cart 48' of station 46'. Hence, laundry travelling along section 65' of the conveyor can be selectively transferred to any desired dryer or finishing station by automatically extending the conveyor and turning on the conveyor drive motor.

The dryers 43' and 44' are each convention self-unloading dryers. While various unloading mechanisms for dryers can be used, it is preferred that each dryer be provided with a pair of rear cylinders 96 to cause the dryer to tilt forward to unload. When dryer 43' is tilted forward, the dried laundry discharges onto the inlet end 72 of conveyor 67' and the laundry is then conveyed downstream for example to be transferred to cart 48' by extended transfer conveyor 77 at folding station 46'. Unloading of dryer 44' is accomplished in the same manner by tilting the dryer forward by operating its rear cylinders 96.

Where the laundry travelling along leg 65' of the dryer takes the form of for example bed sheets, no drying is necessary, and transfer conveyor 76 is extended. The laundry is then conveyed from conveyor 66' to conveyor 67' to conveyor 68', but is intercepted by transfer conveyor 76 which conveys it to ironing station 45'.

It is to be understood that the pneumatic conveyor 35', loading chutes 37'–39', washing machines 40'–42', dryers 43', 44' and conveyor system 62' are merely typical of the type of equipment that can be used, in accordance with this invention, and that this equipment will vary from one installation to another depending on the nature of the existing equipment, or the equipment to be installed to provide for automatic operation of the laundry. For example, each washing machine 40'–42' can be associated with chutes which are arranged to extend and move into door opening 58' to load the machine. With such a loading system, guide chute 56' and rearward tilt cylinders 55' are of course not required. The washing machine can also be of a wholly different type and automatic unloading can be done in any desired way. Similarly, the dryers can have any desired unloading mechanism.

To conserve water as well as energy where hot water is used for rinsing the wash, it is present practice to reuse rinse water, especially from a final rinse of the laundry, as the wash water for the next load of soiled laundry. For this purpose, a suitable storage tank 80' can be provided into which rinse water from one batch of laundry is pumped for reused as the wash water for subsequently washed soiled laundry.

In the soiled laundry room 108 where the suction inlet 36' of pneumatic conveyor 35' is located, laundry is initially loaded on a conveyor 112 and is then transferred to conveyor 113 which transfers the laundry to conveyor 114 which deposits the laundry on a loading table 115 from which it is drawn into suction inlet 112.

Adjacent conveyor 112 is a selector 116, in accordance with this invention, for selecting the entire cycle of operation of the various work to be done on the laundry, so that the laundry is wholly untouched by an operator until it reaches the desired final station. When a batch of sorted laundry is loaded on conveyor 112, the operator simply sets selector 116 to the name of the laundry to be processed. Then, the operator merely actuates a "loaded" switch, and thereafter, the laundry is automatically processed and sent to its final destination.

Figure 9:
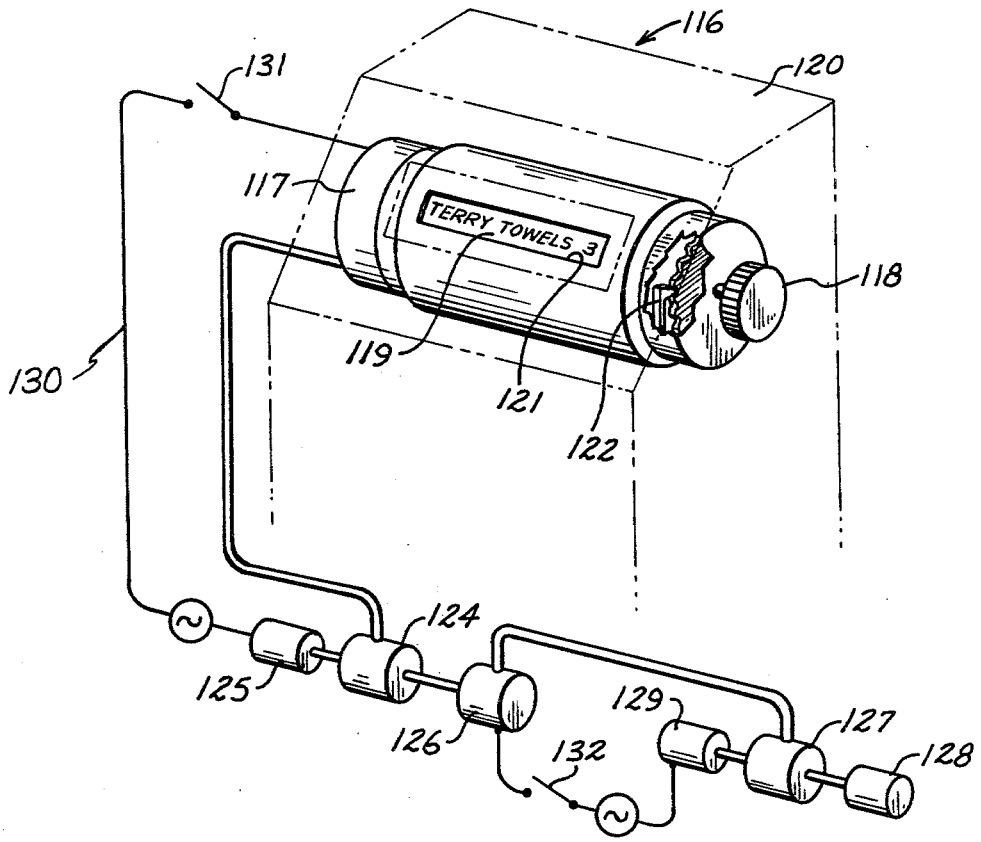
FIG. 9 is a view partly pictorial and partly diagrammatic showing a master selector and selector information transfer units, according to the invention.

As shown at FIG. 9, the selector 116 takes the form of a multi-position selector switch. As shown at FIG. 9, selector 116 preferrably includes a multi-position manually rotatable selector switch 117 which can be indexed to various rotary positions by a hand knob 118. Also rotated by hand knob 118 is a drum on which the names of various types of laundry are printed. There is a different laundry name designation 119 for each different position of selector switch 117. Unit 116 is preferrably enclosed in a casing 120 having a window 121 through which only one laundry name 119 is visible. A spring and detent 122 maintains the selector in the position to which it is manually set. Selector switch 117 is a master switch or transmitter of a master-slave system for driving a follower switch or receiver to the position manually set on the master switch when the follower is instructed to receive the information. A master-slave system which can be used is disclosed in U.S. Pat. No. 2,474,576. That system is a 36 position selector system, but a system with more or less positions can be used.

Such a system basically includes a master switch or transmitter such as 117, and a follower switch or receiver such as follower 124 which can be located at a remote location from transmitter 117, and which is wired to the transmitter. Follower 124 is driven by a motor 125 so interconnected with transmitter 117 that the follower is driven to the position set at transmitter 117. Where there are several storage stations such as conveyor 113 and conveyor 114, it is necessary to transfer the selection setting of unit 116 and its transmitter 117 to follower 124 when the laundry is transferred to conveyor 113 so that selector 116 can be reset when the next batch of laundry is loaded on conveyor 112. The motor 125 which drives follower 124 also drives an additional transmitter 126 which in turn is connected to a follower 127 associated with conveyor 114 and which has a transmitter 128 driven by its drive motor 129. However, follower 127 must not be driven until it is ready to receive the information from transmitter 126, since the information in transmitter 128 must be transferred to the next follower in the line before its setting can be changed.

As shown at FIG. 9, the drive motor for follower 124 is controlled by a return line 130 of transmitter 117. A normally open switch 131 in this return line permits setting the transmitter 117 to any one of its thirty-six different positions without driving follower 124. However, when switch 131 is closed, the motor of follower 124 is energized and moves the follower to a position corresponding to the position of transmitter 117.

Similarly, the transmitter 126 cannot transfer its position setting to follower 127 until its transfer switch 132 is closed. The manner in which this control system transfers the information step by step and simultaneously tracks the laundry will now be explained.

Figure 10:
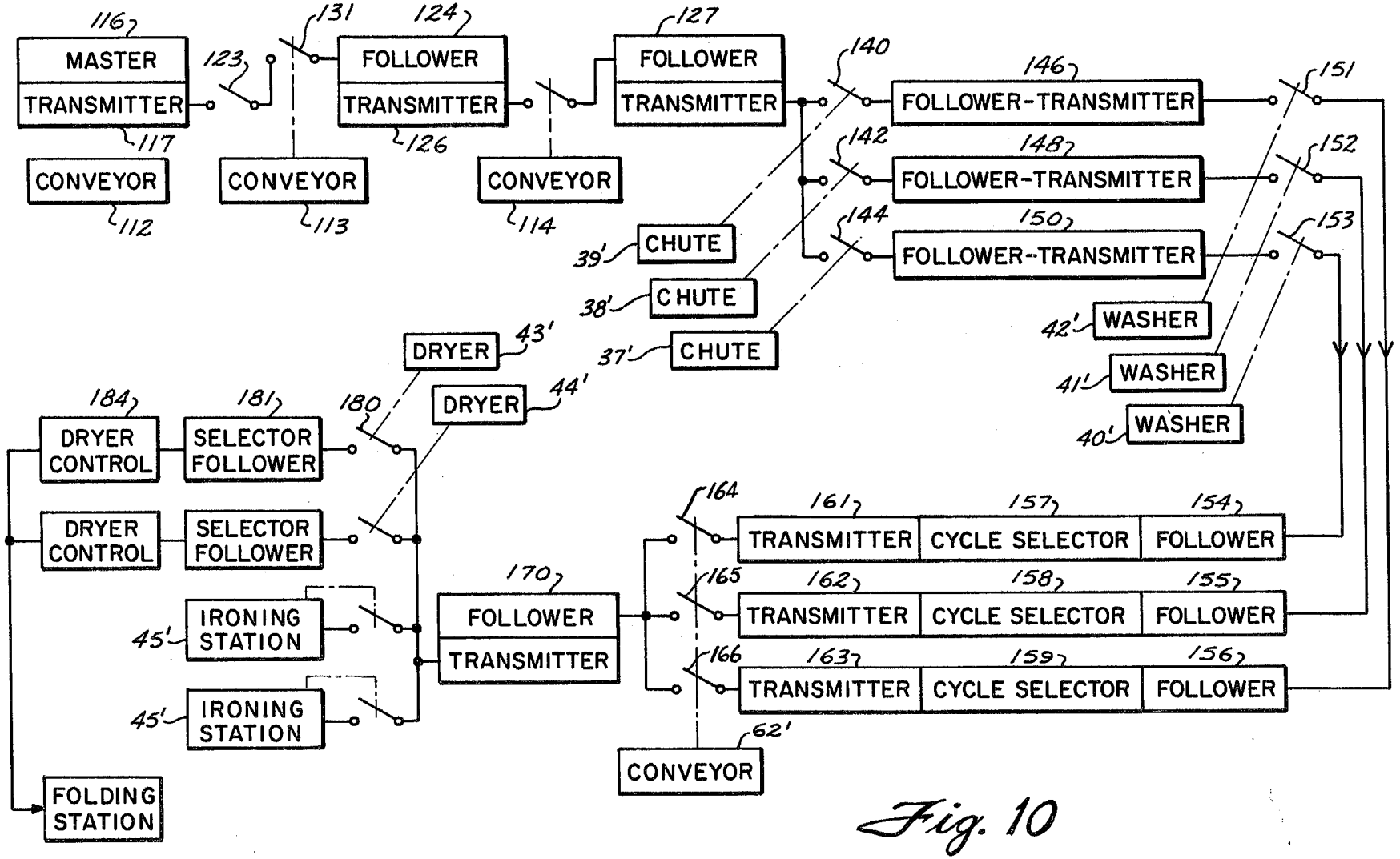
FIG. 10 is a block diagram, partly in schematic, showing the data transfer and control system.

Referring to FIG. 10, master selector 116 is shown as associated with conveyor 112. Follower 124 is associated with conveyor 113 and follower 127 is associated with conveyor 114. With laundry on conveyor 112, the operator rotates knob 118 of selector 116 to a position corresponding to the name of the laundry for example, terrycloth towels. The operator then presses a ready switch 123 which conditions master selector 116 to transfer the position setting of transmitter 117 to follower 124, when the follower is ready to receive the information. The time that the information is transferred is determined by the condition of storage conveyor 113. If conveyor 113 is empty, as sensed by light from lamp 133 impinging on photocell 134, conveyor 112 is energized to transfer the laundry to conveyor 113, and the energization of conveyor 112 actuates transfer switch 131 to transmit the position of master selector 116 to follower 124. With the information transferred to follower 124, and photocell 135 illuminated by lamp 136, indicating that conveyor 114 is empty, conveyor 113 starts and the transmitter 126 transfers its position information to follower 127. Conveyor 114 is activated to feed laundry onto table 115 and thus into inlet 36' of pneumatic conveyor system 10 only when one of chutes 37'–39' is empty and its unloading door 59' is closed. When a chute becomes available, for example, immediately following loading of laundry from chute 38' to washer extractor 41', a switch in chute 38' signals its availability to receive the next load from conveyor 114. If sufficient time has elapsed since the previous loading of pneumatic conveyor 35' by conveyor 114, the availability signal from chute 38' causes loading door 52' to open and conveyor 114 to feed laundry into inlet 36' of the pneumatic system and into chute 38' through the open chute door 52'. At the end of a predetermined period of time for example on the order of 1–2 minutes, conveyor 114 is stopped, and the control for cylinder 53' times out to close the door 52' of chute 38'. At the time door 52' of chute 38' opened, transfer device 140 was actuated to transfer the data from transmitter 126 to follower 148, associated with the chute 38'.

In addition, there are transfer devices 151–153 for follower units 154, 155 and 156 associated respectively with washer extractors 37'–39'. Transfer units 154–156 are actuated respectively in response to loading of a particular washer, and such transfer to, for example, washer 38' occurs in response to the final step of rearward tilting of the washer, positioning of intermediate or loading chute 56, and opening of door 59' of chute 17. When the control is activated which operates the cylinder for the door 59' of chute 38', transfer device 153 is actuated to transfer its position information to follower 155.

Associated with and driven by each of followers 154–156 are the respective cycle selectors 157–159. These cycle selectors, as a result of their indexing to a position corresponding to master selector 116, control the entire washing cycle of the laundry automatically loaded into the respective machines.

Figure 11:
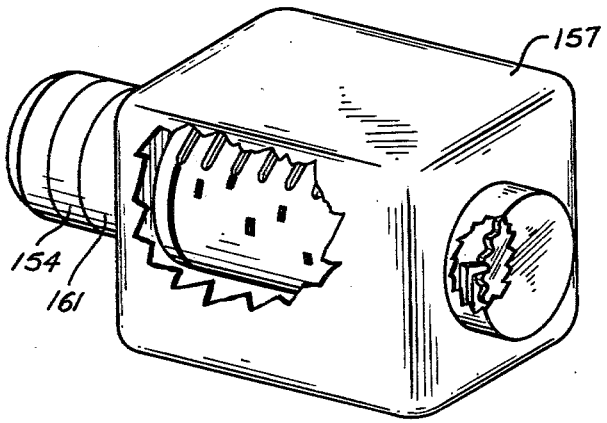
FIG. 11 is a pictorial view of a remote or follower driven selector according to the invention.

Each cycle selector 157–159 includes a contact finger arrangement, chart, and drum essentially identical to that shown in FIG. 3, and previously described. In addition, as shown at FIG. 11, each selector, such as selector 157, is driven by a motor and has a follower 154 and a transmitter 161. As shown at FIG. 10, there are similar transmitters 162 and 163 for the cycle selectors 158 and 159. There is an additional follower 170 associated with storage section 64 of the conveyor. Transfer devices 164–166 are between the transmitters 161–163 and follower 170. As a result, when a washing machine, such as washing machine 41' tilts forward to unload on to conveyor 62', the laundry is conveyed to storage section 64' and simultaneously, the data from one of transmitters 161–163 is sent to follower 170. However, the system is provided with a photocell interlock so that if there is any laundry on either storage section 64' or conveyor section 62', the washing machines are automatically blocked against unloading. Such a photocell lock out can take the form of a photocell 171 at one end of conveyor section 62' and a light source 172 at the other end of conveyor section 62'. A similar lamp 173 and photocell 174 on storage conveyor 64' prevents unloading of laundry so long as there is laundry on either leg of the conveyor.

With laundry on storage section 64' of the conveyor, and a dryer available for drying, such as dryer 43', the dryer signals its availability for loading. Such an availability signal can be in response to lowering of the dryer after it unloads a previous load of laundry. With the dryer signal received, and where the laundry is of the type which requires drying, transfer conveyor 74 is extended, and in response to extension of the transfer conveyor, its drive motor is started to drive its belt in a direction toward the dryer. Simultaneously, the conveyor system is started, and the laundry stored on section 64' is conveyed along conveyor 66', drops onto conveyor 74 and is thus loaded into the dryer.

At the time the transfer conveyor 74 was extended into the dryer, a transfer device 180 was operated which transferred the data from follower 170 to a transmitter 180 which in turn set a selector 181 associated with dryer 43' to its corresponding position. The transferred data is that data contained in the fingers 29' through 33' of a selector such as that shown at FIG. 11, save that this selector only requires these five fingers because the washing segment of its program has already been completed.

Each dryer has a controller 184 which is pre-programmed to dry laundry in accordance with three different drying cycles. Where the laundry is of the permanent press type, an additional cool down is required after drying, and such cool down can be a part of one of the cycles. In the manner previously explained, with reference to FIG. 2, and controller 2 of a washing machine, the dryer controller is rapidly indexed to the start of one of its three drying cycles, as selected by fingers 29', 30' of the selector, which contain the dry cycle select information. There is, however, no modification of the drying cycles by the controller.

The other data transmitted to the selector 181 is the ultimate destination of the laundry from the dryer, namely to one of the final stations 46' or 47'.

When the dryer is ready to unload, the data contained in its selector 181 at fingers 31', 32', 33' activates one or the other of transfer conveyors 77, 78 and conveyors 66'–70' are each turned on and driven until the laundry unloaded from the dryer reaches, for example, the transfer conveyor 77. Unloading of the dryer is accomplished by extending its tilt cylinders 96 so that the laundry is dumped onto conveyor 67'. The transfer conveyor 74 is, of course, retracted at this time so it does not interfere with unloading. With the transfer conveyor 76 extended, the laundry is intercepted and loaded into cart 48', for example, for folding. Suitable interlocks are provided along conveyor leg 65' so that only one load of laundry can be conveyed along this leg of the conveyor at any one time.

Where the information contained in fingers 29'–33' of follower 170 indicates that no drying is required, the laundry from storage section 64' is directly conveyed to ironing station 45'. The information in the fingers advances transfer conveyor 76 so that the washed but undryed laundry is automatically transferred to the ironing station where the still slightly damp laundry, such as bed sheets, is simultaneously ironed and dryed.

The various signals from, for example, the laundry chutes, the washing machines, the dryers, or the various sections of the conveyor, are merely representative of the signals which can be used to activate the system at each stage of its operation so that the laundry is automatically processes, and its processing data is automatically transferred. Numerous changes and variations can be made without departing from the scope of this invention.

What is claimed is:

1. In an automatic laundry processing system for performing predetermined operations sequentially upon individual laundry work loads, the combination comprising:

a plurality of work load processing stations;

conveyor means comprising a plurality of conveyor units for receiving individual laundry work loads from certain ones of said processing stations and depositing said individual laundry work loads at other one of said stations:

memory means comprising a plurality of memory units with one of said memory units being associated with each one of said processing stations and one of said memory units being associated with each of said conveyor units for storing individual laundry work load identification signals, said individual laundry work load identification signals being uniquely associated with individual laundry work loads;

transfer means for transferring individual laundry work load identification signals between said memory units in accordance with said associated individual laundry work loads being moved between said conveyor units and said processing stations; and control means comprising a plurality of control units associated with each of said processing stations for controlling the processing of said individual laundry work loads in response to said individual laundry work load identification signals.

2. The system of claim 1 wherein said plurality of work load processing stations comprises a plurality of laundry washing machines; means for automatically loading an individual laundry work load into each of said plurality of washing machines; and the means for unloading an individual laundry work load from each of said plurality of laundry washing machines.

3. The system of claim 2 wherein said plurality of laundry processing stations further includes a plurality of laundry drying machines; means for automatically loading an individual laundry work load into each of said laundry drying machines; and means for automatically unloading an individual laundry work load from each of said plurality of laundry drying machines.

4. The system of claim 1 wherein said transfer means includes sensor means comprising a plurality of sensors with each sensor being operatively associated with one of said conveyor units or processing stations for producing a signal indicative of the presence or absence of a laundry work load at that conveyor unit or processing station.

5. The system of claim 1 wherein said transfer means further includes transfer control means responsive to said sensor means for transferring said individual laundry work load identification signals between said memory units when an absence of a laundry work load is indicated at a next sequential conveyor unit or processing station.

6. The system of claim 1 wherein each of said control units includes a plurality of preprogrammed processing sequences; and selector means responsive to said individual laundry work load identification signals for selecting one of said preprogrammed sequences.

7. The system of claim 6 wherein said selector means also includes modifying means for modifying said preprogrammed sequences in response to said individual laundry work load identification signals.

8. The system of claim 7 wherein each of said control units comprising a rotary drum; power means for rotating said rotary drum; and actuator means on said rotary drum for actuating a plurality of switch means in a predetermined sequence.

9. The system of claim 8 wherein said selector means comprises a selector rotary drum; and selector switch means operated by said selector rotary drum for controlling the actuation of said power means.

10. The system of claim 9 wherein said modifying means includes a plurality of modifying switch means operatively engaged with said selector rotary drum for modifying said preprogrammed sequences.

11. The system of claim 1 wherein each of said memory units comprises the follower of a transmitter-follower mechanism and further wherein said transfer means includes the transmitter of said transmitter-follower mechanism.

* * * * *